US006144149A

United States Patent [19]

Youn et al.

[11] Patent Number: 6,144,149

[45] Date of Patent: Nov. 7, 2000

[54] CATHODE RAY TUBE

[75] Inventors: Hae-su Youn, Ulsan; Jin-woo Park, Yangsan, both of Rep. of Korea

[73] Assignee: Samsung Display Devices Co., Ltd., Kyungki-Do, Rep. of Korea

[21] Appl. No.: 09/208,993

[22] Filed: Dec. 11, 1998

[30] Foreign Application Priority Data

Dec. 15, 1997 [KR] Rep. of Korea ..... 97-68879

[51] Int. Cl.[7] ..... H01J 29/07

[52] U.S. Cl. ..... 313/407; 313/479

[58] Field of Search ..... 313/407, 402, 313/404, 479, 326

[56] References Cited

U.S. PATENT DOCUMENTS 5,189,334 2/1993 Park ..... 313/407 X
5,898,259 4/1999 Reyal ..... 313/407 X

*Primary Examiner*—Ashok Patel
*Attorney, Agent, or Firm*—Lowe Hauptman Gopstein Gilman & Berner

[57] ABSTRACT

In a cathode ray tube, a shadow mask has a hole portion where a plurality of electron beam passing holes are formed and a skirt portion extending from the edge of the hole portion. A frame has a support portion to which the skirt portion of the shadow mask is fixed for supporting the shadow mask and a flange portion extending from the support portion. The support portion and the flange portion have a plurality of holes formed therein. An inner shield is supported by the frame.

4 Claims, 3 Drawing Sheets

CATHODE RAY TUBE

BACKGROUND OF THE INVENTION

1. Field of the Invention

The present invention relates to a cathode ray tube, and more particularly, to a cathode ray tube having an improved structure of a frame and an inner shield for supporting a shadow mask.

2. Description of the Related Art

A cathode ray tube (CRT) is an imaging apparatus which displays a predetermined image by scanning an electron beam onto fluorescent material coated on the surface of a panel. CRT is widely used for a television set, a computer monitor, an oscilloscope, etc.

FIG. 1 is a sectional view of a typical CRT. Referring to the drawing, a CRT 1 includes a panel 10 having a fluorescent film 11 formed on the inner surface thereof, a funnel 30 coupled to the panel 10 forming a seal, a shadow mask 12 installed at a predetermined interval from the fluorescent film 11, a frame 20 for supporting the shadow mask 12, a hook spring 23 for supporting the frame 20 with respect to the panel 10, and a stud pin 24. Also, the CRT 1 has an electron gun 33 installed at a neck portion 31 of the funnel 30 and a deflection yoke 34 installed at a cone portion 32 of the funnel 30. Reference numeral 22 represents an inner shield.

FIG. 2 is a cross-sectional view showing a portion of the CRT of FIG. 1 in detail. In the drawing, the frame 20 having an "L" shaped section has a support portion 20*a* and a flange portion 20*b*. The edge of the shadow mask 12 is supported at the inner side of the support portion 20*a* of the frame 20. The inner shield 22 has a peripheral portion 22*a* which can be fixed to the flange portion 20*b* of the frame 20.

In the CRT having the above structure, an electron beam emitted from the electron gun 33 is deflected by the deflection yoke 34 and passes through electron beam passing holes formed in the shadow mask 11 to be scanned onto the fluorescent film 11. The electron beam landed on the fluorescent film 11 excites fluorescent material to display a predetermined image.

The frame 20 usually has a thickness of 0.8–1.6 mm to maintain its strength and a material of pure steel is used therefor. Thus, magnetic attraction through the frame 20 increases due to the earth's magnetic field, which has a negative effect on the trajectory of the electron beam at the stage of driving the CRT. Previously, in order to prevent the above problem, a high voltage had to be applied to a degaussing coil (not shown) for removing the effect by the earth's magnetic field. That is, stronger magnetic field is generated by increasing the voltage applied to the degaussing coil and is used to compensate for the earth's magnetic field for the frame 20. However, since this method cannot completely remove the effect by the earth's magnetic field, the trajectory of the electron beam is affected by the earth's magnetic field and thus the quality of image becomes inferior.

SUMMARY OF THE INVENTION

To solve the above problem, it is an objective of the present invention to provide a CRT having an improved structure so that the effect by the earth's magnetic field on the frame can be removed.

Accordingly, to achieve the above objective, there is provided a cathode ray tube which comprises: a shadow mask having a hole portion where a plurality of electron beam passing holes are formed and a skirt portion extending from the edge of the hole portion; a frame having a support portion to which the skirt portion of the shadow mask is fixed for supporting the shadow mask and a flange portion extending from the support portion, the support portion and the flange portion having a plurality of holes formed therein; and an inner shield supported by the frame.

It is preferred in the present invention that a reinforced portion is formed by bulging a portion of the frame to improve rigidity of the frame.

Also, it is preferred in the present invention that a reinforced plate is attached to the frame to improve rigidity of the frame.

Further, it is preferred in the present invention that the inner shield has a peripheral portion which is bent to correspond to the shapes of the support portion and the flange portion of the frame, to surround at least a part of the support portion and the flange portion, and an obliquely extended portion which extends from the extended circumferential protion.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 3:
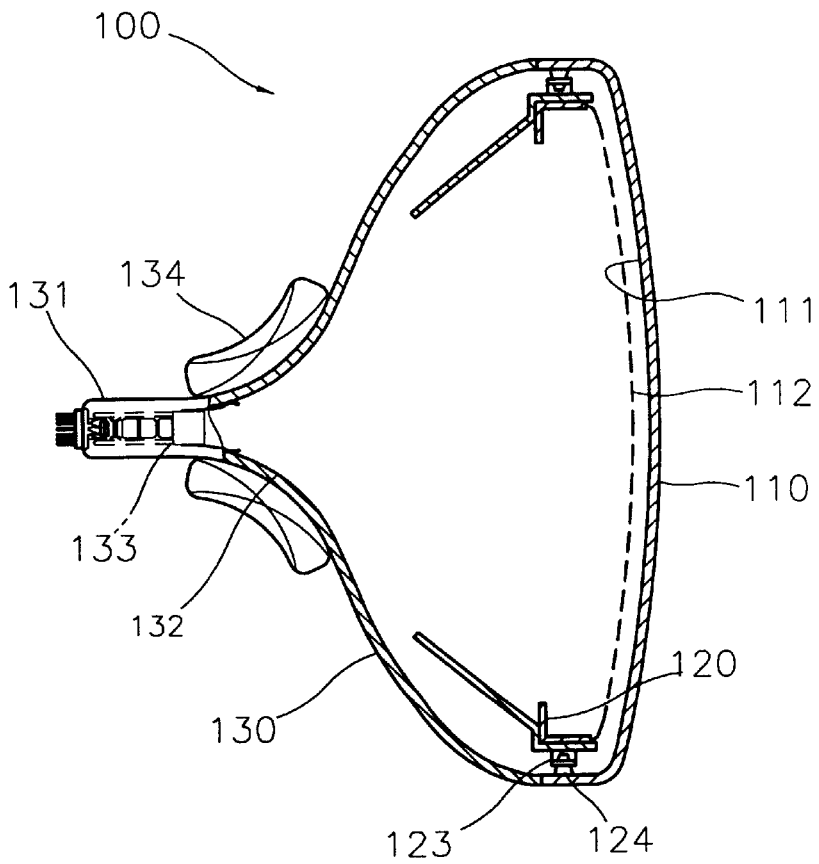
FIG. 3 is a vertical sectional view of a CRT according to the present invention.

FIG. 3 shows a CRT in which a shadow mask support according to the present invention is installed. Referring to the drawing, a CRT 100 includes a panel 110 having a fluorescent film 111 formed on the inner surface thereof, a funnel 130 coupled to the panel 110 forming a seal, a shadow mask 112 installed at a predetermined interval from the fluorescent film 111, a frame 120 for supporting the shadow mask 112, a hook spring 123 for supporting the frame 120 with respect to the panel 110, and a stud pin 124. Also, the CRT 100 has an electron gun 133 installed at a neck portion 131 of the funnel 130 and a deflection yoke 134 installed at a cone portion 132 of the funnel 130.

Figure 4:
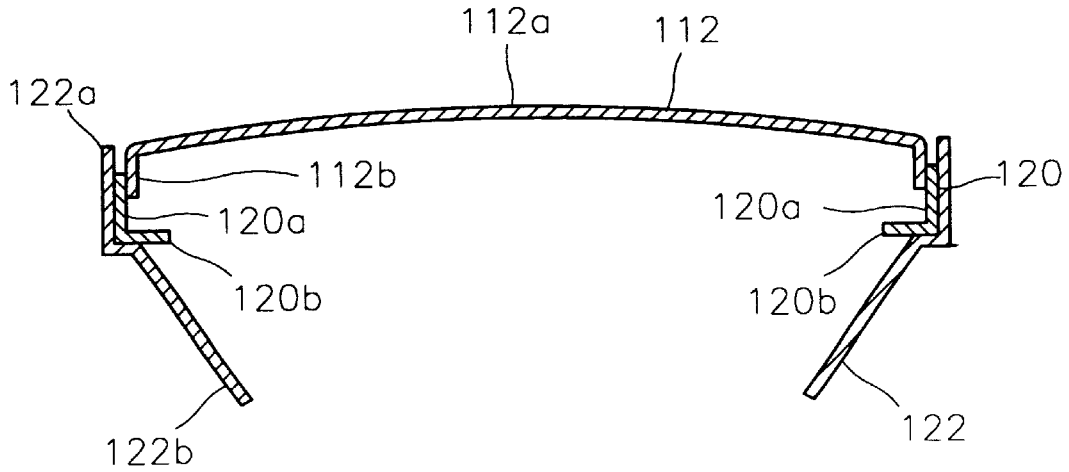
FIG. 4 is a sectional view of a portion of the CRT shown in FIG. 3.

FIG. 4 shows a portion of the CRT shown in FIG. 3. Referring to the drawing, the shadow mask has hole portion 112*a* in which a plurality of electron beam passing holes are formed and a skirt 112*b* extended from the edge of the hole portion 112*a*. The frame 120 has a support portion 120*a*, fixed to the skirt portion 112*b* of the shadow mask 112, for supporting the shadow mask 112 and a flange portion 120*b* extended perpendicularly from the support portion 120*a*. The shadow mask 112 can be supported at the inner surface or the outer surface of the support portion 120*a* of the frame 120 according to types thereof. In a preferred embodiment shown in the drawing, however, the shadow mask 12 is supported at the inner surface of the support portion 120*a*. A peripheral portion 122*a* of the inner shield 122 is extended such that it can completely surround the support portion

120*a* and a part of the flange portion 120*b* of the frame 120 from the outside.

Figure 5:
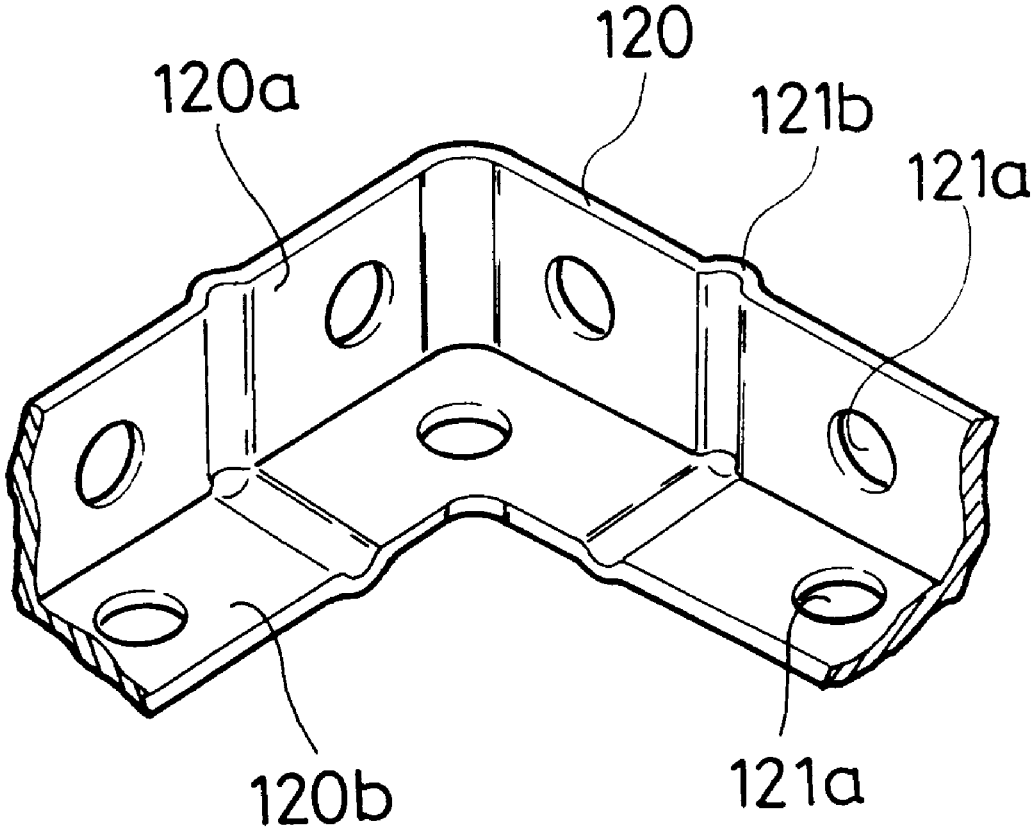
FIG. 5 is a perspective view showing a portion of the frame shown in FIG. 4.

FIG. 5 is a perspective view showing a portion of the frame 120 of FIG. 4. Referring to the drawing, a plurality of holes 121*a* are formed in the support portion 120*a* and the flange portion 120*b* of the frame 120. It has been well-known that the holes 121*a* have an effect of compensating for magnetic influence. That is, the holes 121*a* formed in the frame 120 can reduce an effect of the earth's magnetic field through the frame 120.

Also, reinforced portions 121*b* are formed in the frame 120. The reinforced portions 121*b*, for example, are formed by transforming a part of the support portion 120*a* or the flange portion 120*b* of the frame 120 as shown in the drawing. Alternatively, a reinforced plate (not shown) is attached to the support portion 120*a* or the flange portion 120*b* to obtain the same effect. The reinforced portion 121*b* reinforces rigidity of the frame 120 so that a thin frame can exhibit the normal performance. The reinforced portion 121*b* may be formed to bulge the frame 120 either inwardly or outwardly.

Referring to FIG. 4 again, the inner shield 122 is fixed to the frame 120. The inner shield 122 has a peripheral portion 122*a* which contacts and is fixed to the support portion 120*a* and a portion of the flange portion 120*b* of the frame 120 and an obliquely extended portion 122*b* which extends from the peripheral portion 122*a*. The peripheral portion 122*a* is bent to correspond to the shapes of the support portion 120*a* and the flange portion 120*b* of the frame 120.

As shown in FIG. 4, the inner shield 122 is extended to completely surround the outer surface of the frame 120. The correlation between the inner shield 122 and the frame 120 is helpful to reduce the effect due to the earth's magnetic field. That is, while an electron beam passes through a space formed by the frame 120, the effect due to the earth's magnetic field through the frame 120 can be shielded by the inner shield 122. Preferably, the inner shield 122 is 0.15 mm thick and formed of a material exhibiting superior magnetic permeability (u).

The CRT 100 according to the present invention operates as follows.

Figure 1:
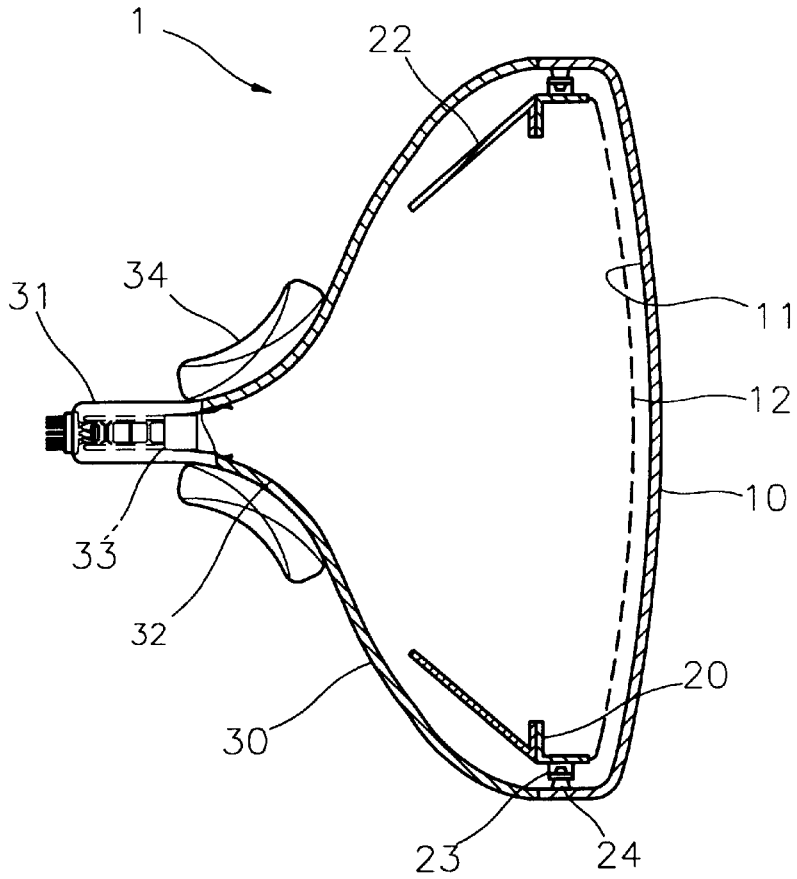
FIG.1(PRIOR ART)
FIG. 1 is a vertical sectional view of a typical CRT.
Figure 2:
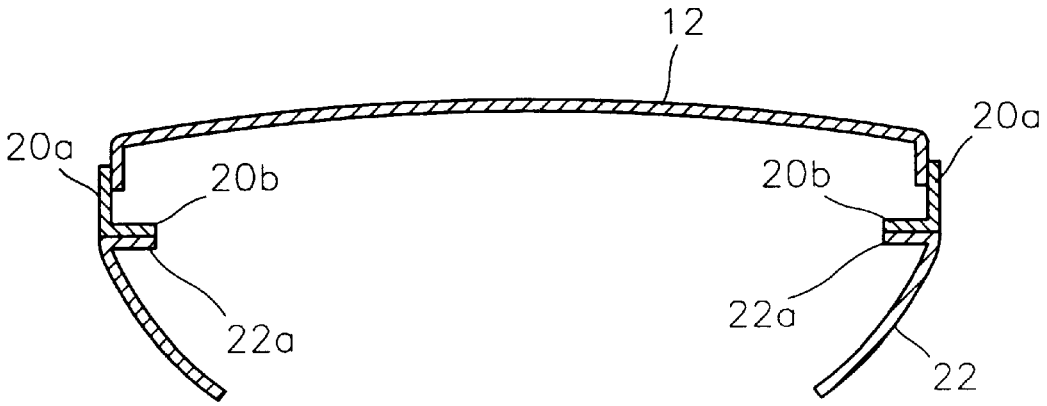
FIG.2(PRIOR ART)
FIG. 2 is a sectional view of a portion of the CRT shown in FIG. 1.

As only a part of an electron beam emitted from the electron gun 133, i.e., part of thermions, passes through the electron beam passing holes of the shadow mask 112, the electron beam landed on the shadow mask 112 is lost as heat. Thus, at the initial stage of driving the CRT 100, the shadow mask 112 supported by the frame 120 is thermal-expanded within a relatively short period to the frame 120, causing a rapid doming phenomenon. Then, the frame 120 expands due to the heat transferred from the shadow mask 112 so that the doming phenomenon of the shadow mask 112 is removed and the shadow mask 112 is leveled. At this time, the distance between the shadow mask 112 and the fluorescent film 111 becomes wide. The change of the distance above is corrected by the hook spring 23 (see FIG. 1) which supports the frame 120.

Since the reinforced portion 121*b* is formed at the frame 120, the thickness of the frame 120 can be set as relatively being thin. If a thin frame maintaining a predetermined rigidity is available, the time for expanding the frame by the heat transferred from the shadow mask 112 can be shortened. Therefore, within a relatively short time, the doming phenomenon of the shadow mask 112 and the frame 120 can be solved and a thermally balanced state can be resumed.

As a plurality of the holes 121*b* are formed throughout the entire surface of the support portion 120*a* and the flange portion 120*b* of the frame 120, the effect due to the earth's magnetic field becomes less. Also, as the peripheral portion 122*a* of the inner shield 122 exhibiting superior magnetic permeability completely surrounds the frame 120, the earth's magnetic field can be shielded more effectively. As a result, efficiency of shielding the earth's magnetic field improves. Also, the electron beam can maintain the trajectory thereof as designed originally, thus improving the quality of an image.

It is noted that the present invention is not limited to the preferred embodiment described above, and it is apparent that variations and modifications by those skilled in the art can be effected within the spirit and scope of the present invention defined in the appended claims.

What is claimed is:

1. A cathode ray tube comprising:

a shadow mask having a hole portion where a plurality of electron beam passing holes are formed and a skirt portion extending from the edge of said hole portion;

a frame having a support portion to which said skirt portion of said shadow mask is fixed for supporting said shadow mask and a flange portion extending from said support portion, said support portion and said flange portion having a plurality of holes formed therein; and an inner shield supported by said frame.

2. The cathode ray tube as claimed in claim 1, wherein a reinforced portion is formed by bulging a portion of said frame to improve rigidity of said frame.

3. The cathode ray tube as claimed in claim 1, wherein a reinforced plate is attached to said frame to improve rigidity of said frame.

4. The cathode ray tube as claimed in claim 1, wherein said inner shield has a peripheral portion which is bent to correspond to the shapes of said support portion and said flange portion of said frame, to surround at least a part of said support portion and said flange portion, and an obliquely extended portion which extends from said extended circumferential protion.

* * * * *